US005803473A

United States Patent [19]

Bouden

[11] Patent Number: 5,803,473

[45] Date of Patent: Sep. 8, 1998

[54] CONFIGURABLE WHEEL TRUCK FOR SKATEBOARDS OR ROLLER SKATES INCORPORATING NOVEL WHEEL DESIGNS

[75] Inventor: James D. Bouden, Boise, Id.

[73] Assignee: Jerome F. Eberharter, Boise, Id.

[21] Appl. No.: 600,309

[22] Filed: Feb. 12, 1996

[51] Int. Cl.[6] ..... A63C 17/00

[52] U.S. Cl. ..... 280/87.042; 280/11.19

[58] Field of Search ..... 280/11.19, 11.23, 280/11.25, 11.27, 11.28, 87.041, 87.042; 301/5.3, 5.7

[56] References Cited

U.S. PATENT DOCUMENTS

| | | | |
|---|---|---|---|
| 329,845 | 11/1885 | Mundy | 280/11.28 |
| 3,355,185 | 11/1967 | Carter | 301/5.7 |
| 3,362,722 | 1/1968 | Core | 280/87.042 |
| 3,995,873 | 12/1976 | Pantzar | 280/87.042 |
| 4,047,727 | 9/1977 | Holladay et al. | 280/87.042 |
| 4,138,127 | 2/1979 | Kimmell et al. | 280/11.28 |
| 4,515,379 | 5/1985 | Pasques | 280/11.27 |

FOREIGN PATENT DOCUMENTS

| | | | |
|---|---|---|---|
| 418930 | 2/1967 | Switzerland | 280/11.23 |

*Primary Examiner*—Brian L. Johnson
*Assistant Examiner*—Min Yu
*Attorney, Agent, or Firm*—Robert L. Shaver; Frank J. Dykas; Albert M. Crowder, Jr.

[57] ABSTRACT

A novel skate platform wheel truck and wheel design which permits reconfiguration of the wheels and truck to incorporate two, three, four, or more wheels per truck with the wheels incorporating novel designs which provide stability and control configurable to the skill of the user.

4 Claims, 8 Drawing Sheets

CONFIGURABLE WHEEL TRUCK FOR SKATEBOARDS OR ROLLER SKATES INCORPORATING NOVEL WHEEL DESIGNS

FIELD OF THE INVENTION

This invention relates primarily to skateboards and roller skates and more particularly, to an improved skate wheel truck and wheels incorporating novel wheel designs for use therewith.

BACKGROUND OF THE INVENTION

Skateboards are well known devices having numerous references in the art. It is also well known that they can be extremely dangerous to someone unskilled in their use. Early attempts to alleviate this problem resulted in such solutions as the eight-wheel skateboard having four wheels per truck as described in U.S. Pat. No. 4,062,557 and an improvement thereto found in U.S. Pat. No. 4,337,961 wherein an endless belt is positioned around paired wheels with each truck having two pair. An alternative, U.S. Pat. No. 4,515,379, addressed a similar but slightly different problem for unskilled skaters. When passing over uneven terrain or a curb, having an upward projection which may come in contact with the truck axle housing, causing an abrupt halt to the skateboards forward progress with potential danger to the user. The '379 patent utilizes a small roller positioned axially between the wheel pairs and has a radius smaller than the truck wheels so that the roller would normally clear objects when a person is skating on a flat, level terrain, but the roller would engage an upward extending object and roll over rather than impacting upon the object.

However, as a skateboard rider becomes more skilled and begins to attempt acrobatic maneuvers and narrow radius turns as well as increasing travel speeds, the above-described devices tend to inhibit such use by increasing the turning radius when attempting acrobatics and turns and limiting the speed achievable by the rider.

For the more skilled rider, attention has been toward improving the design of the wheel, such as that found in U.S. Pat. No. 4,070,065 and U.S. Pat. No. 4,128,254 which are directed to increasing traction and resistance to sideways slip of the wheel during turn and to reduce loss of speed during sharp turns due to greatly increased rolling friction as a result of lip deformation of the wheel.

Thus, there is a need for skateboards having wheel truck configurations and wheel designs that provide a relatively stable and safe platform for the beginning user and, at the same time, can be reconfigured as the user gains experience with use of the board in order to perform acrobatics and turns such as can be found in exhibitions and contests of skateboarding.

SUMMARY OF THE INVENTION

According to present invention, there is provided a newly designed skateboard truck assembly configurable to incorporate three, four, five or more wheels per truck and arranged to provide the stability and control required by the skill of the user. Further, the wheels incorporate novel designs configurable toward enhancing the stability and smoothness of the ride whether in use by a beginner or by an expert.

Additionally, the truck is designed to be compatable with existing skateboard mounting hardware so that existing boards can be easily retrofit with the novel truck configuration of the present invention.

In one configuration, each truck assembly has three wheels placed in axial alignment. A large wide wheel is mounted in the center of the truck assembly with two smaller width wheels mounted axially on either side of the large center wheel. The center wheel has a small bevel at each edge and the small side wheels are beveled with the bevel forming the same angle as the center wheel edge bevels.

In another configuration, the center wheel is narrower than the previously described configuration and includes a pair of wheels mounted axially on either side of the center wheel for a total of five wheel per truck. The surface along the circumference of the wheel is flat, with the side wheel pairs having beveled surfaces.

It is envisioned the skateboard utilizes two of either of the above described truck assemblies and during use, while riding in a straight line, the two large center wheels ride flat on the surface. As the rider shifts weight to begin a turn, the two center wheels roll off their center surface and onto the beveled edges of the side wheels and, during the turn, the harder the rider leans, the sharper the radius of the turn as the side wheels come into play, helping the user's control in keeping the the board from tipping over. Further, the board is more stable at high speeds as two wheels run truer in form, enabling the user to exercise better control of the higher speed.

Accordingly, it is the object of the present invention to provide the skateboard having a ride with the more natural feeling of skimming across the surface of water or snow such as when using an actual surfboard or snowboard. A further object of the present invention is to provide a skateboard that is more stable at higher speeds and capable of a greater range of motion including sharper radius turning than that of present skateboards.

It is a feature of the present invention to provide a skateboard or roller skate wheel truck configurable in either of two, three, four, five or more wheels per truck configurations, permitting the board to be readily adapted to the uses and skills of the rider.

BRIEF DESCRIPTION OF THE DRAWINGS

These and other features, objects and advantages of the present invention will become better understood with reference to the following description, depending claims, and accompanying drawings where:

FIG. 2A is a breakout view showing wheel bevel angle θ.

DETAILED DESCRIPTION

Figure 1:
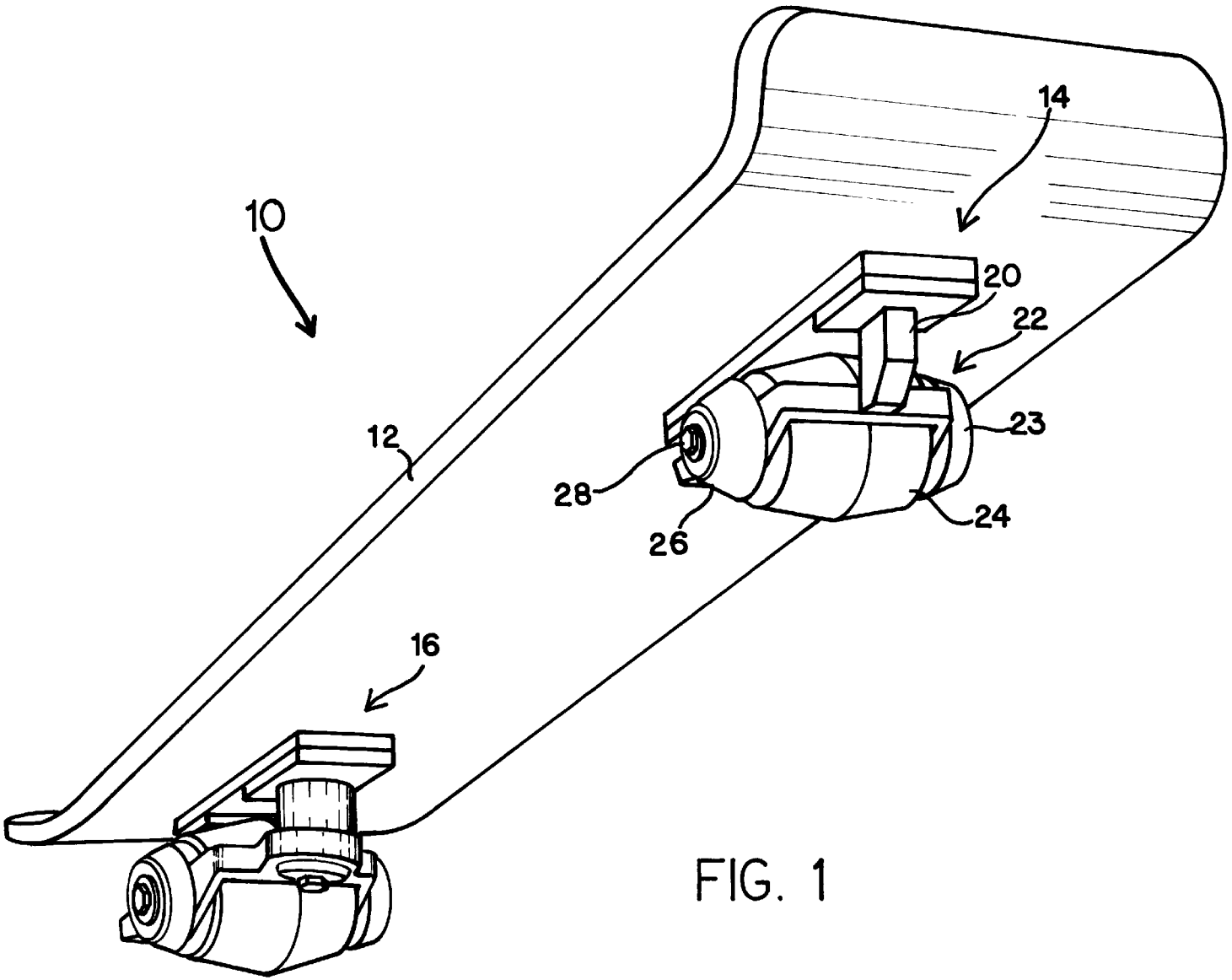
FIG. 1 is a perspective view of a skateboard incorporating the three-wheel configuration of the skateboard wheel truck and innovative wheel design of the present invention.

Referring now to FIG. 1, an improved skateboard incorporating one embodiment of the present invention is generally illustrated at 10. Skateboard 10 includes a platform 12, a front carriage or wheel truck assembly 14, and a rear carriage or wheel truck assembly 16 in accordance with the present invention. Truck assemblies 14 and 16 are identical and are rotated 180° with each other and mounted on a mounting block 20 adjacent opposing ends of the platform 12. As each carriage or wheel truck assembly 14,16 is identical, only truck assembly 14 of the various embodiments of the present invention will be described in detail.

Figure 2:
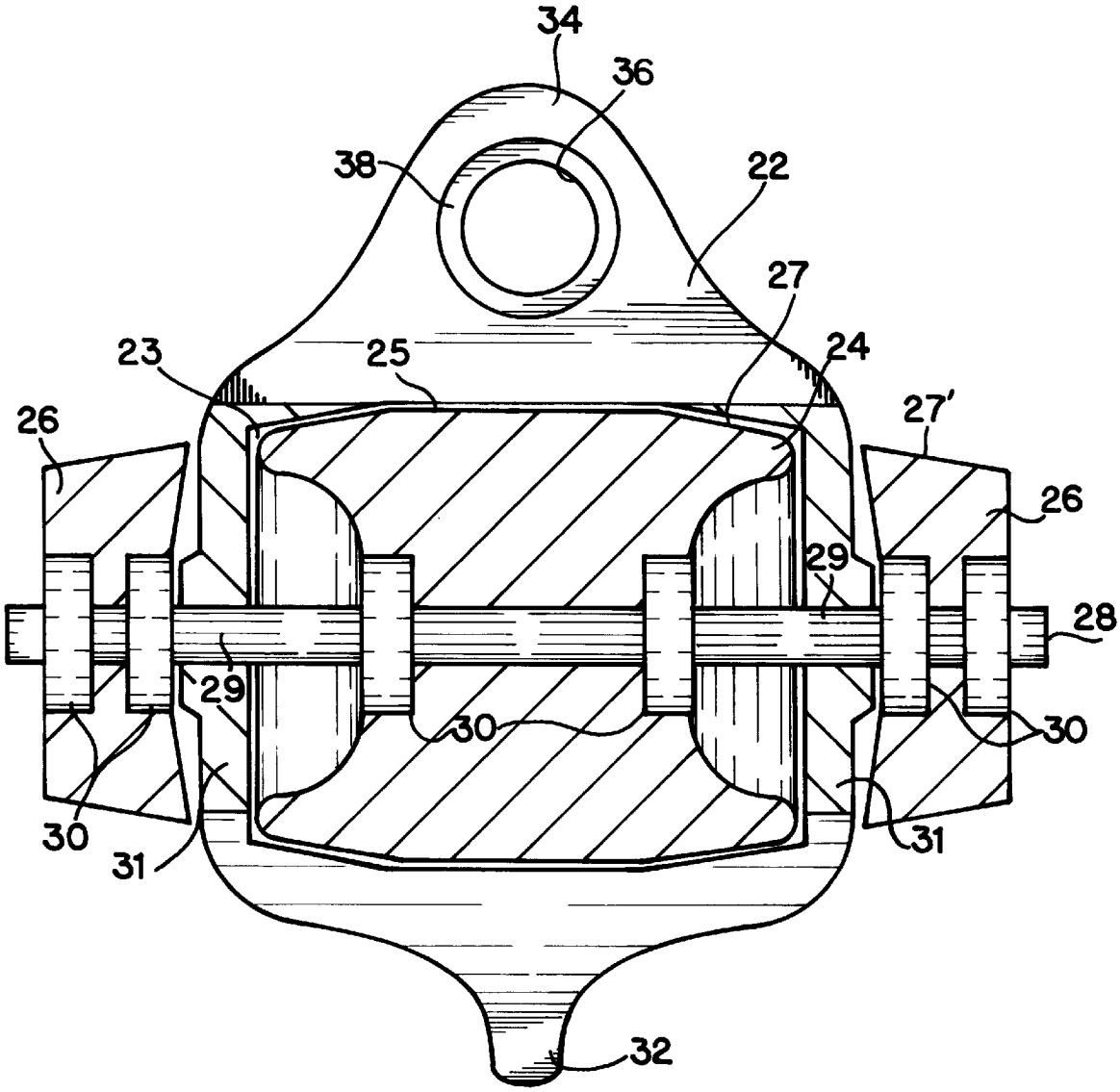
FIG. 2 is a cross-sectional view along the longitudinal wheel truck axis incorporating a three wheel configuration and illustrating one embodyment of the innovative wheel design of the present invention.
Figure 3:
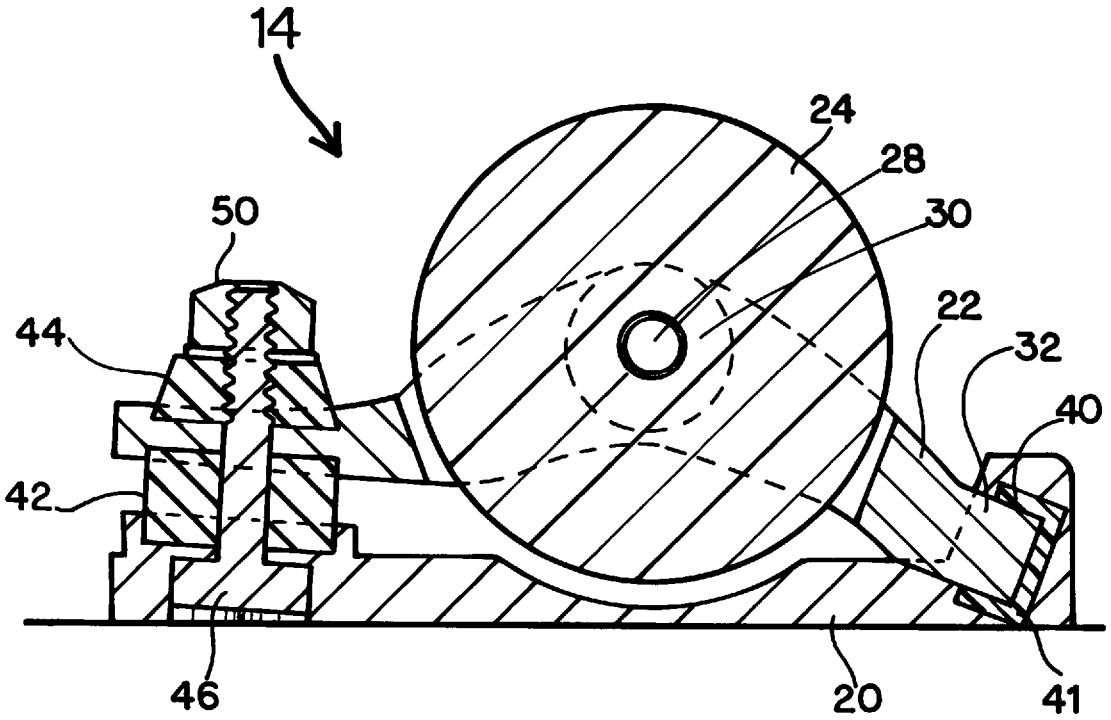
FIG. 3 is an axial cross-sectional view of the wheel truck of FIG. 1 showing the mounting configuration of the present invention.

Wheel truck assembly 14, and referring now to FIG. 2 and 3, comprises a mounting block 20 which is afixed to the lower surface 18 of platform 12 and a wheel mounting frame 22 including parallel arms or sidewalls 31 extending between a flange 34 and a rounded tip 32 and defining a rectangular opening 23 therebetween sufficient to receive a main or center wheel 24. Frame 22 includes openings 29 formed in the frame 22 sidewalls 31 for receiving in a relatively snug fit, wheel axle 28 for supporting wheels 24, 26 within frame 22 while permitting wheels 24, 26 to freely rotate on wheel bearings 30 formed within the wheels 24, 26.

It is to be understood that the wheels 24, 26, utilize wheel bearings 30 such as are now known in the art and which are formed in the interior of the wheels to rotate around axle 28. However, it is within the scope of this invention that as improvements are made in bearings and the like, they may be incorporated in the disclosed invention without departing from the spirit thereof. Further, frame 22 is connected, and referring now to FIG. 3, to mounting block 20 in a traditional manner shown in prior art methods of connecting wheels trucks to skateboards. however, it is within the scope of this invention that the angle, $\phi$, will be varied, depending on the specific frame used for a specific configuration, and where the angle $\phi$ is defined as $0° \leqq \phi° \leqq 90°$.

Wheel 24 has a diameter about its central axis typical of other skate board wheel such as is known in the art with the pair of side wheels 26, having a slightly lesser diameter. The present invention however, is directed to an innovative design of the wheels 24,26, and their interrelation during operation, as will be discussed hereinafter.

In this embodiment, by way of example and not by way of limitation, wheel 24 has a width on the order of three inches. Wheel 24 includes a central flat portion 25 formed around the circumference of the wheel 24 and has a bevel 27 formed circumferentially on both edges around wheel 24. In the shown embodiment, and referring also to FIG. 2A, each bevel is on the order of ¾ inches wide as measured along a tangent axially along the surface 25 of wheel 24 and forms an angle $\theta$, on the order of 22°, with the aforementioned tangential line.

It will be understood by those skilled in the art that the above dimensions and angles are representative of this embodiment only and that combinations of other dimensions and angles where the surface 25 width is ≧½", and where 2° ≦ angle $\theta \leqq 45°$, and where the surface 27/27' width is ≦⅛", without departing from the scope or intent of the present invention.

Further, axle 28 extends beyond sidewalls 31 to permit auxiliary or secondary wheels 26 to be affixed in rotational alignment around axle 28. In the depicted embodiment, wheels 26 are narrower than wheel 24 and have a beveled circumferential surface 27' with the bevel formed at, and as a continuation of the same angle $\theta$ as formed on wheel 24.

In the depicted embodiments, the wheels utilize bearings formed on the interior thereof, to permit the wheels to rotate around axle 28. Further, frame 22 is connected to mounting block 20 in a manner shown in prior art methods of connecting wheels to platform 12.

Figure 4:
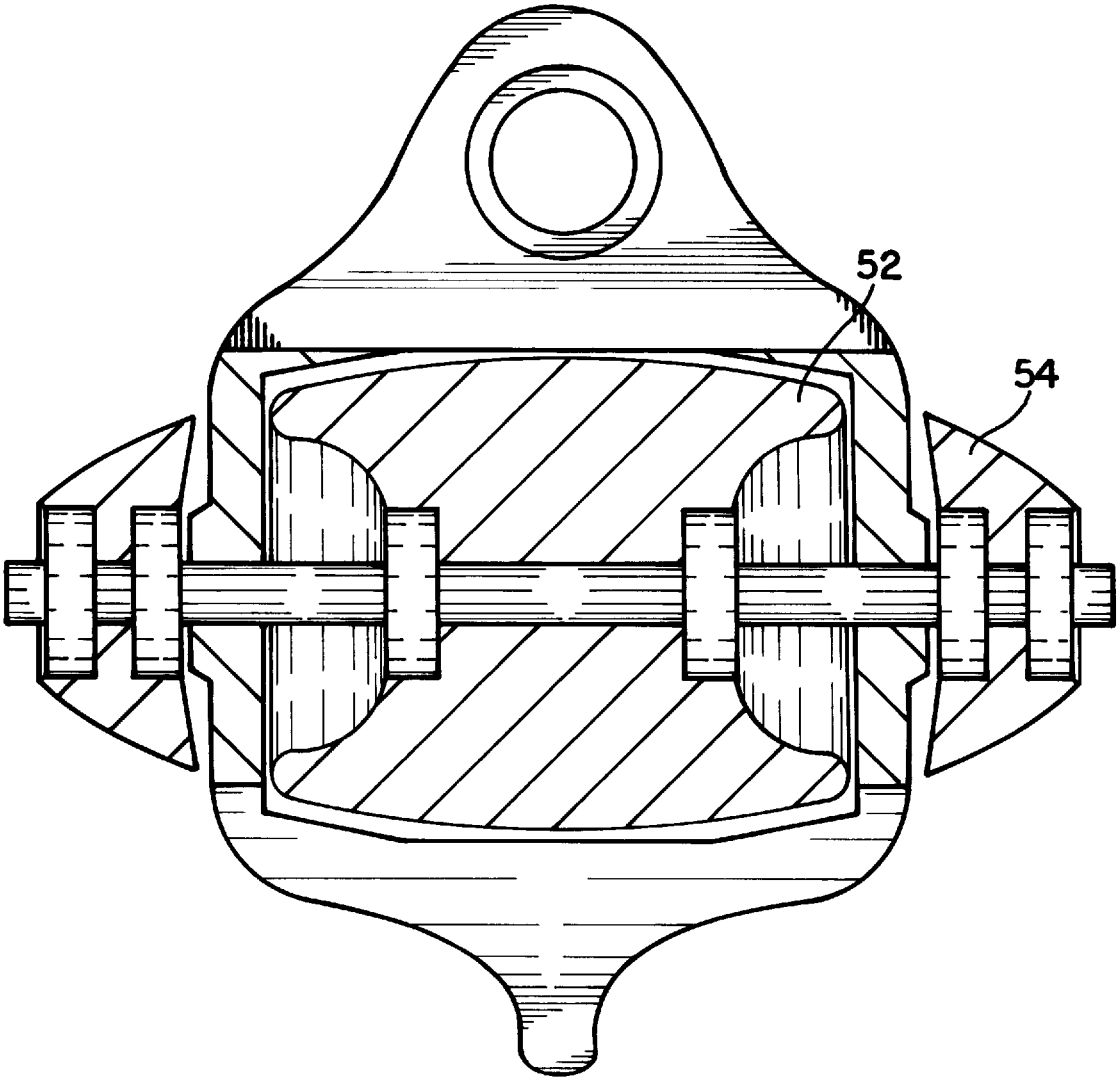
FIG. 4 is a cross-sectional view of the wheel truck in FIG. 1 showing an alternate embodyment of the innovative wheel design of the present invention.

Referring now to FIG. 4, an alternate embodiment of the center wheel 24' is shown to have an elliptical circumferential surface 25'. The outer or side wheels 26' are identical in construction to wheels 26 shown in FIG. 2. The bevel angle $\theta$, has the same range (2°–45°) as shown for bevel 27' in FIG. 2. Further, the housing 22 of truck 14/16 is identical to that in FIG. 2, with the main or center wheel 24' formed by having an elliptical curvature along the circumference thereof.

Figure 5:
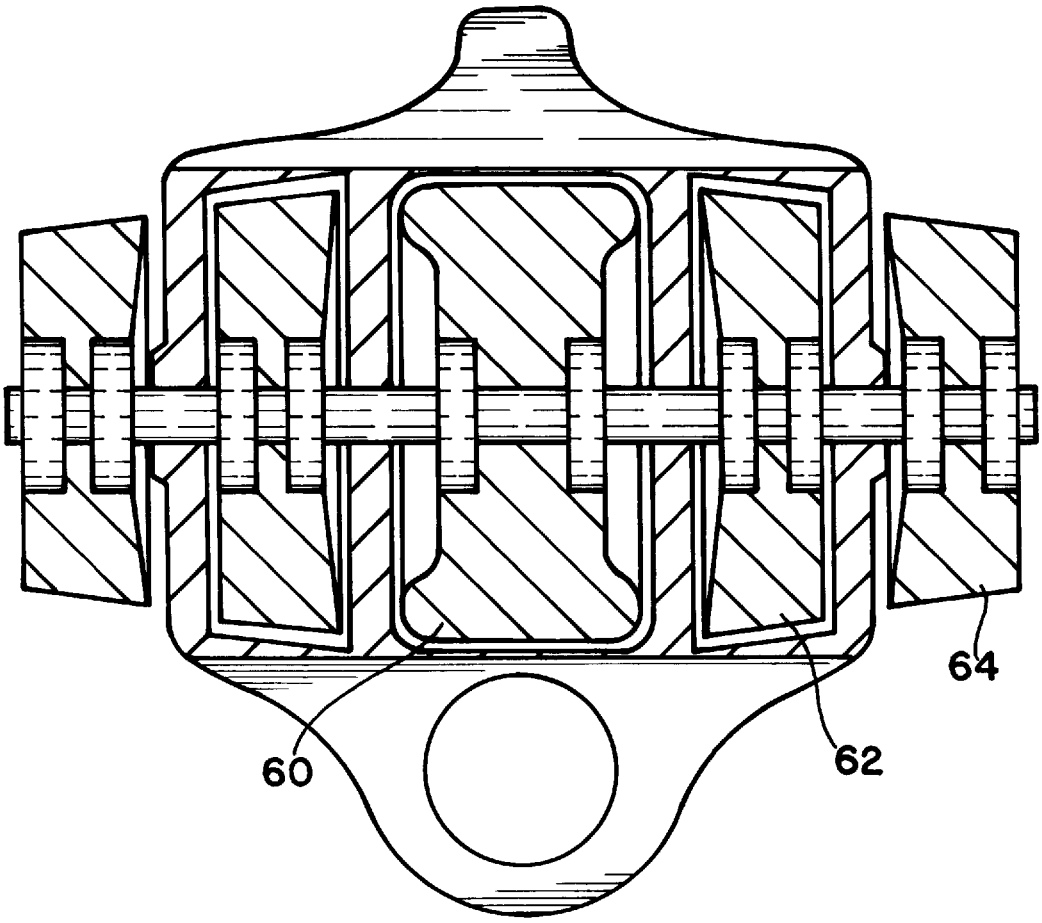
FIG. 5 is a cross-sectional view of the wheel truck of the present invention utilizing a single axle, five-wheel configuration and innovative wheel design.

Referring now to FIG. 5, another alternate embodiment of the present invention is shown to have a modified wheel mounting truck 14'/16' including four parallel arms or sidewalls 66,68 extending between flange 34' snd rounded tip 32' and defining three openings between the rounded knob 32' and mounting flange 34' of the housing 14'/16'. and axle 28' extends through openings formed in the sidewalls to secure in position a main wheel 60 mounted on axle 28' in the center opening defined by sidewalls 66, a pair of first or inner side wheels 64, mounted on axle 28' in the two openings defined by two sidewall pairs, 68,66 and 66,68, and a pair of second or outer side wheels 64, mounted on axle 28' exterior to housing 14'/16' and adjacent to sidewalls 68.

The main wheel 60 is flat in its outer diameter circumference with rounded edges. The sidewheels 62, have a diameter approximately that of main wheel 60 and are beveled at an angle $\theta$. Outer side wheels 64, have a diameter approximately that of the diameter to the bevel diameter of wheel 62 proximate to wheel 64. The circumference of wheel 64 is also beveled at an angle of $\theta$ with respect to a horizontal line axially tangential to the circumference of wheel 64.

Figure 6:
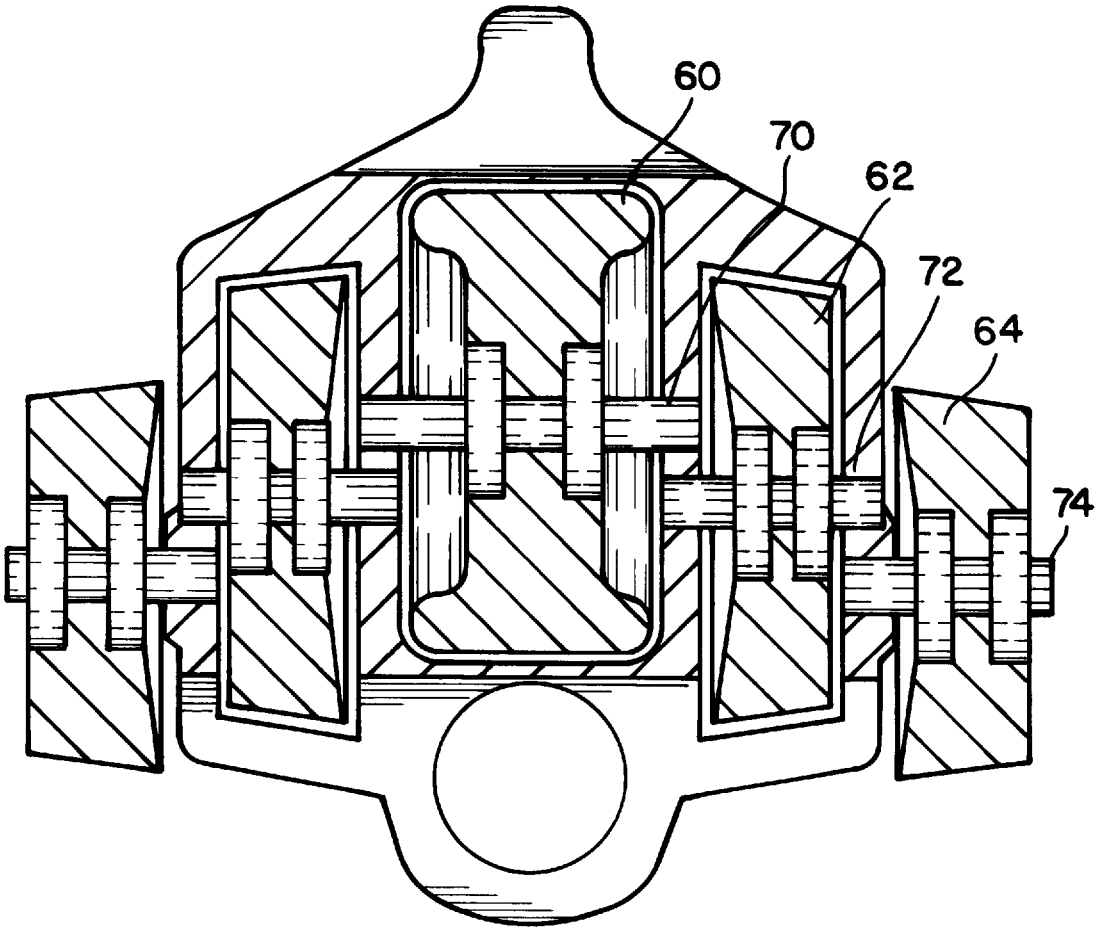
FIG. 6 is a cross-sectional view of the wheel truck of the present invention utilizing a five-axle, five-wheel configuration with the axles in a staggered configuration.

Referring now to FIG. 6, the mounting frame 14"/16" of FIG. 5 has been modified to provide offsetting the first and second side wheels 62,64 so that they are in a swept configuration with main wheel 60 proximate to tip 32' of frame 14"/16" and side wheels 62 swept back towards flange 34' and side wheels 64 being swept further in the same direction as shown. As a result, multiple short axles are utilized, being depicted in FIG. 6 as axle 70, positioned in sidewalls 66' and utilized for the main wheel 60, a pair of axles 72 positioned in both sidewalls 66'68' and utilized for first side wheels 62, and a pair of axles 74, positioned in sidewalls 68' and utilized to position second side wheels 64 externally to frame 14"/16". In use, this embodiment permits turns to be made which have a very short turning radius.

Figure 7:
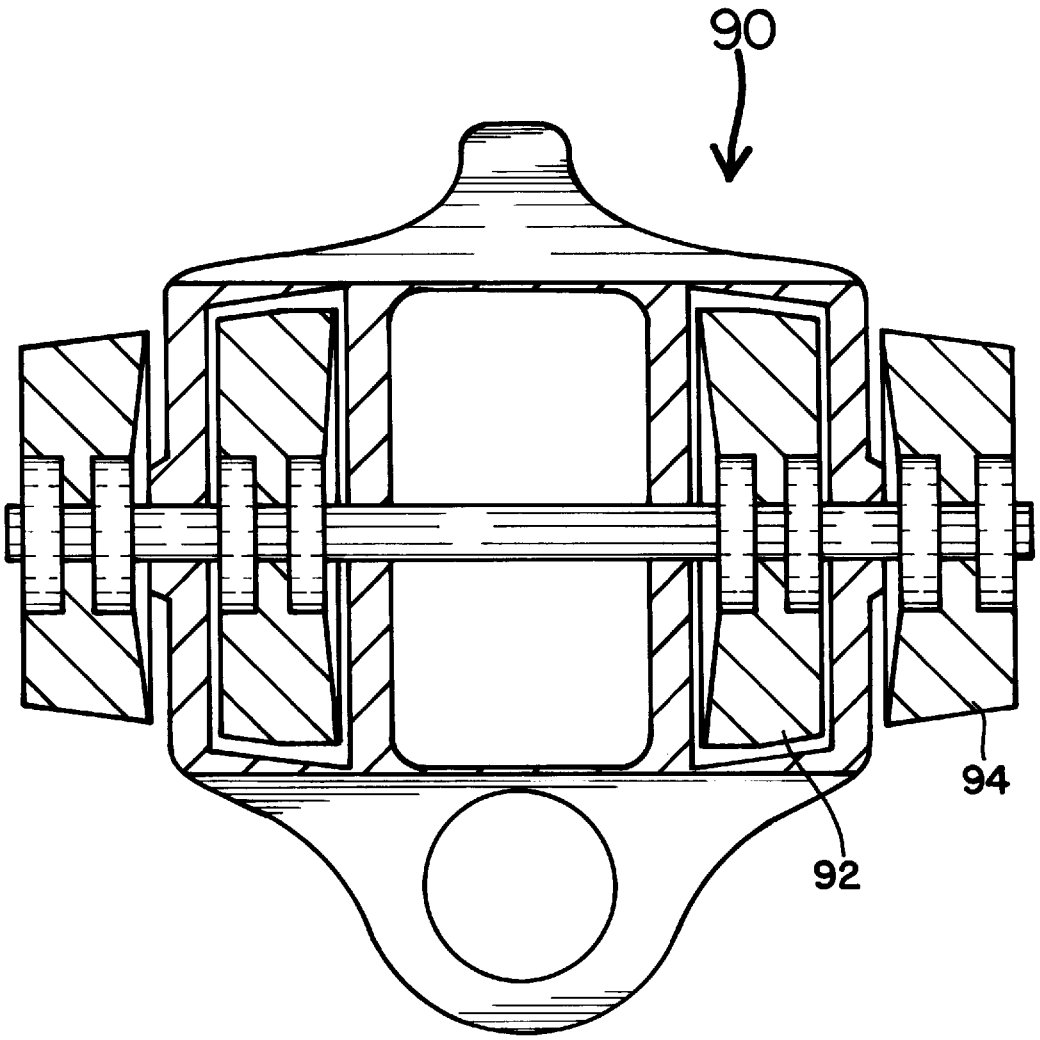
FIG. 7 is a cross-sectional view of the wheel truck of the present invention utilizing four wheels incorporating an innovative wheel design of the present invention.

Referring now to FIG. 7, there is shown still another embodiment of the present invention which utilizes the wheel mounting frame of FIG. 5 with the axle 28' extending completely through the truck frame 14'/16'. However, in this embodiment the main wheel 60 shown in FIG. 5 has been removed and the inner side wheels 92 have been modified to provide a flat surface 93 on the circumference of wheel 92 starting at the edge of wheel 92 proximate to side wall 66 and extending axially along the circumference for a distance of about ¼ the width of wheel 92, but at least ≧⅛", at which point the wheel 92 is again beveled an angle of $\theta°$. faded degrees with a horizontal along the flat portion of the wheel 92 extends to the outer edge thereof. The outer side wheel 64 is identical with outer side wheel 64 depicted in FIG. 5 and again is beveled at an angle of θ°.

Figure 8:
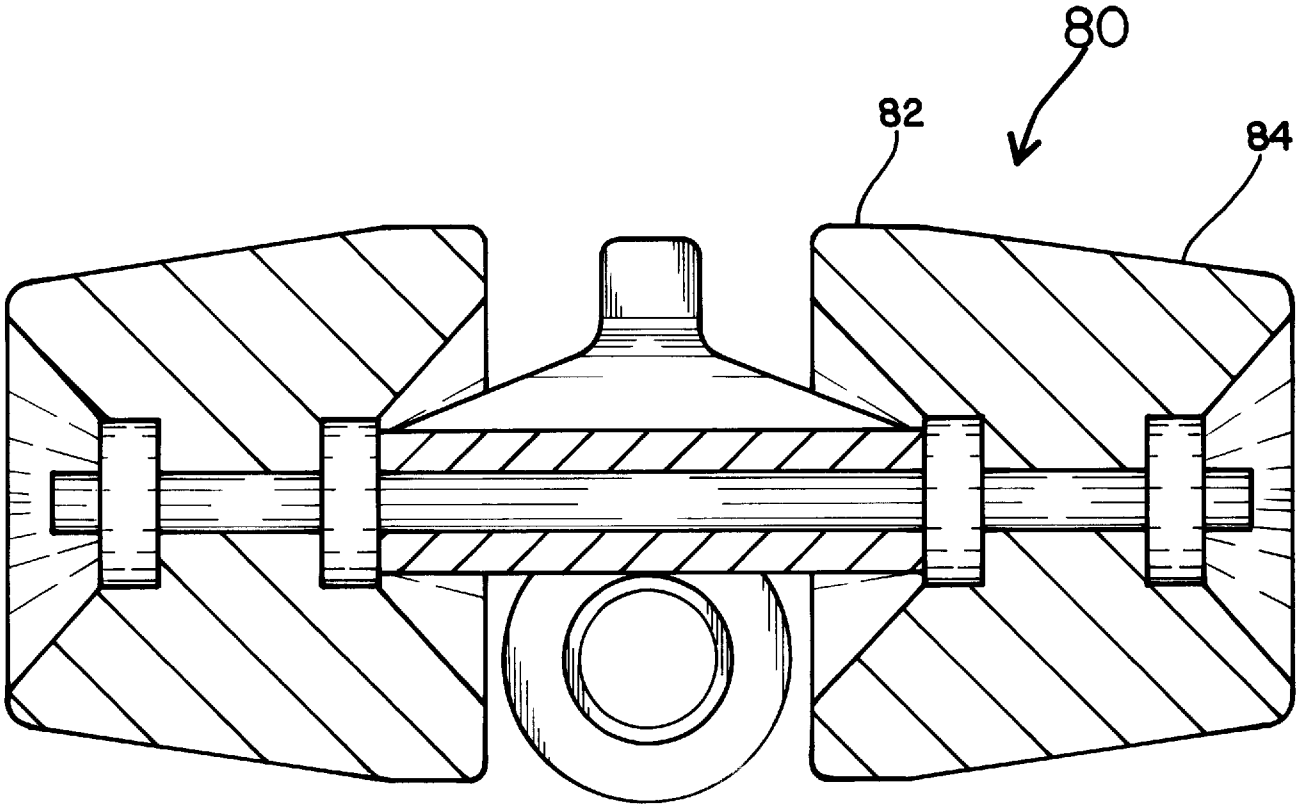
FIG. 8 is a cross-sectional view of the wheel depicted in FIG. 7 as modified for use in a two-wheel per truck configuration.

Referring now to FIG. 8, the wheel similar to that of first outrigger wheel 92 of FIG. 7 but having a greater width and a flat portion 82 ≧⅕ the width of the wheel 84 before beginning a beveled portion at an angle of θ° along the flat portion of wheel 80. These wheels may be utilized as a retrofit for existing skateboards trucks utilizing two wheels so that advantages inherent in the design of the wheels heretofore described may be utilized without purchase of special mounting trucks.

The present invention is directed to a novel skateboard/roller skate wheel design which, in use, provides for a smoother, more natural ride such as may be found when riding a snowboard or surfboard, is readily configurable to provide changes in various ride characteristics such as stability, speed, turning radius, and providing for an eved distribution of load ot the wheels during turns and to innovative wheel truck frames which permit the characteristics inherent in the disclosed wheel design to be fully utilized. By way of example and not by way of limitation with respect to the configurability of the disclosed invention, another embodyment of the present invention, although not shown, envisions removing the secondary wheels of the embodyments depicted in FIG. 2 and 4 to be removed and use would be on the center wheels of the 14/16 wheel truck.

And, although the innovative wheel truck is so designed as to provide a direct retrofit for existing wheel trucks, it is within the purview of the invention that the wheel truck herein described can be modified to fit new designs in skateboard/roller skate wheel truck mounting plates.

Whereas the present invention has been described in relation to the drawings attached hereto, it should be understood that other and further modifications, apart from those shown or suggested herein, may be made within the spirit and scope of this invention.

I claim:

1. A wheel truck and wheel assembly for a skate platform, comprising:

a frame having a first and a second mounting means at opposing ends of the frame;

the frame further including at least a first and a second spaced apart sidemember, each extending between the first and second mounting means and defining a rectangular opening therebetween;

an axle extending across the rectangular opening between the first and second sidemembers and further extending through and beyond the first and second sidemembers;

a first wheel including a flat center surface and a first and a second edge around the circumference thereof and having a first and a second bevel formed on first and second edges of said first wheel;

said first wheel, rotatably mounted on the axle within said rectangular opening a first and a second side wheel, rotatably mounted on the axle adjacent the first and second sidemembers, respectively, outside of the rectangular opening; and each said first and second side wheel beveled around its respective circumference, having a larger diameter adjacent its associated sidemember.

2. The wheel truck and wheel assembly for a skate platform of claim 1, wherein the bevel of the first and second side wheels forms an angle θ° with respect to an imaginary line parallel to the axle and tangential to said larger diameter of said first and second side wheels and θ is defined as 2°≦θ°≦45°.

3. The wheel truck and wheel assembly for a skate platform of claim 1, wherein the bevel of the first and second side wheels extends from the larger diameter to a smaller diameter on each of said first and second side wheels and has a width at the circumference of each of ≧⅛".

4. The wheel truck and wheel assembly for a skate platform of claim 1, wherein the bevel of the first and second side wheels forms an angle θ° with respect to an imaginary line parallel to the axle and tangential to said larger diameter of said first and second side wheels and θ is defined as 2°≦θ°≦45°, and the bevel extends from the larger diameter to a smaller diameter on each of said first and second side wheels and has a width at the circumference of each of ≧⅛".

* * * * *